US006949152B2

(12) United States Patent
Hallit et al.

(10) Patent No.: US 6,949,152 B2
(45) Date of Patent: Sep. 27, 2005

(54) HYPERGOLIC AZIDE FUELS WITH HYDROGEN PEROXIDE

(75) Inventors: Ramona E. A. Hallit, Newbury Park, CA (US); George Bauerle, Simi Valley, CA (US)

(73) Assignee: The Boeing Company, Chicago, IL (US)

( * ) Notice: Subject to any disclaimer, the term of this patent is extended or adjusted under 35 U.S.C. 154(b) by 16 days.

(21) Appl. No.: 10/431,983

(22) Filed: May 8, 2003

(65) Prior Publication Data

US 2004/0221933 A1 Nov. 11, 2004

(51) Int. Cl.[7] ..... C06B 47/00
(52) U.S. Cl. ..... 149/1
(58) Field of Search ..... 149/1, 17, 45, 149/74, 109.4; 60/211

(56) References Cited

U.S. PATENT DOCUMENTS

| | | | |
|---|---|---|---|
| 3,933,543 | A | 1/1976 | Madden |
| 3,970,588 | A | 7/1976 | Taylor et al. |
| 4,062,708 | A | 12/1977 | Goetz |
| 4,316,359 | A | 2/1982 | Sayles |
| 4,324,819 | A | 4/1982 | Birbara |
| 4,348,303 | A | 9/1982 | Birbara |
| 4,620,415 | A | 11/1986 | Schmidt |
| 5,152,136 | A | 10/1992 | Chew et al. |
| 5,485,722 | A | 1/1996 | Schmidt et al. |
| 5,621,156 | A | 4/1997 | Thompson |
| 5,747,665 | A | 5/1998 | Thompson |
| 6,013,143 | A | 1/2000 | Thompson |
| 2003/0015268 | A1 * | 1/2003 | Dobbins et al. ..... 149/109.4 |

OTHER PUBLICATIONS

Thompson, Wilson & Stevenson, III; Hypergolic Azide Liquid Fuels; U.S. Army Aviation and Missile Command, ATTN: AMSAM–RD–PS, Jun. 1998.

Darlilng & Kavanagh; Report No. 19; Hydrazine Hydrate; Jul. 15, 1947.

Melof & Grubelich; Investigation of Hypergolic Fuels with Hydrogen Peroxide; AIAA 2001–3837; Jul. 8–11, 2001.

* cited by examiner

*Primary Examiner*—Aileen Felton
(74) *Attorney, Agent, or Firm*—Harness Dickey & Pierce P.L.C.

(57) ABSTRACT

Hypergolic fuel propulsion systems contain a fuel composition and an oxidizer composition. The fuel composition contains an azide compound that has at least one tertiary nitrogen and at least one azide functional group, as well as a catalyst that contains at least one transition metal compound. The fuel composition optionally further contains a hydrocarbon fuel. The oxidizer composition contains hydrogen peroxide. The transition metal catalyst is preferably selected from the group consisting of compounds of cobalt and manganese. The invention provides a method for propelling a vehicle by providing a fuel mixture that spontaneously ignites with the oxidizer composition in an engine to provide thrust.

17 Claims, No Drawings

HYPERGOLIC AZIDE FUELS WITH HYDROGEN PEROXIDE

FIELD OF THE INVENTION

The present invention relates to hypergolic azide fuels with hydrogen peroxide. More specifically, the invention provides fuels containing azide compounds and transition metal catalysts that spontaneously ignite on contact with an oxidizer composition.

BACKGROUND OF THE INVENTION

Chemical fuels release their energy when combined with an oxidizing composition in such a way that a spontaneous chemical reaction occurs. In the case of conventional fuels for land vehicles, the fuel is a hydrocarbon mixture such as gasoline or diesel fuel and the oxidizing composition is air. The fuel burns in the presence of air when initiated by, for example, a spark in an internal combustion engine. For applications requiring higher energy output or thrust, such as rocket or missile propulsion systems, bi-propellant fuel mixtures are generally used. In such bi-propellant mixtures, the fuel and the oxidizer are unstable when mixed together and are generally stored separately.

Bi-propellant rocket propulsion systems consist of oxidizer and fuel propellant tanks, pressurizing system, plumbing, valves, and an engine. A pressurant gas tank or gases from a gas generator pressurize the oxidizer and fuel propellant tanks. When the oxidizer and fuel valves open, the pressurized oxidizer and fuel tanks force the propellants through the plumbing into the engine where the propellants are mixed and ignited. The propellant may be ignited either by ignition aids or by hypergolic chemical reaction. Because ignition aids take up valuable space and weight in the propulsion system, a hypergolic chemical reaction is the preferred ignition method. Certain combinations of fuel and oxidizer are so reactive with one another that they ignite upon contact with one another. The chemical reaction of the fuel and the oxidizer occurs so rapidly that enough heat is generated to continue the combustion reaction in the engine, producing thrust.

Currently known hypergolic bi-propellant rocket propulsion systems have a number of drawbacks. For example, one system consists of monomethylhydrazine and red fuming nitric acid. Because such materials are very toxic, it would be preferred to replace those chemicals in a rocket propulsion system with chemicals less harmful to health. Other commonly used highly toxic storable oxidizers include dinitrogen tetraoxide, mixed oxides of nitrogen, and nitric acid. Commonly used hypergolic fuels used with these oxidizers include hydrazine, monomethylhydrazine and unsymmetrical dimethylhydrazine, all of which are carcinogenic. In U.S. Pat. No. 6,013,143, Thompson has disclosed hypergolic fuel mixtures that contain less-toxic components such as dimethylaminoethylazide (DMAZ). The fuel is hypergolic with inhibited red fuming nitric acid. Although hydrogen peroxide is listed as a possible oxidizer in the Thompson patent, it has been found that the DMAZ fuel by itself is not hypergolic with hydrogen peroxide.

In U.S. Pat. Nos. 5,932,837 and 6,419,771, the Navy has recently created methanol-based fuels that are hypergolic in the presence of highly concentrated hydrogen peroxide (greater than 95%). A shortcoming of using methanol or other low molecular weight alcohols is its low flash point. For example, the flash point of methanol is too low to be considered for some military applications.

It would be desirable to provide bi-propellant systems that avoid the use of toxic and/or dangerous chemicals such as dinitrogen tetraoxide, mixed oxides of nitrogen, nitric acid, hydrazine, monomethylhydrazine and unsymmetrical dimethylhydrazine. Further, it would be desirable to provide hypergolic fuel compositions having a high enough flash point to be useful in military applications.

SUMMARY OF THE INVENTION

Hypergolic bi-propellant propulsion systems are provided that contain a fuel composition and an oxidizer composition. The fuel composition contains an azide compound that has at least one tertiary nitrogen and at least one azide functional group, as well as a catalyst that contains at least one transition metal compound. The oxidizer composition contains hydrogen peroxide in water. The transition metal catalyst is preferably selected from the group consisting of compounds of cobalt and manganese. The oxidizer composition preferably contains hydrogen peroxide at a concentration of 85% or greater. In another embodiment, the invention provides a method for propelling a vehicle by burning fuel in an engine by contacting the fuel composition with the oxidizer composition in the engine to provide a fuel mixture that spontaneously ignites and provides thrust.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

The following description of preferred embodiment(s) is merely exemplary in nature and is in no way intended to limit the invention, its application, or uses.

Hypergolic fuel propulsion systems of the invention contain two components—a fuel composition and an oxidizer composition. In an engine, the two components are contacted with one another to produce a fuel mixture that spontaneously ignites. Preferably, ignition occurs within 10 milliseconds of contact. Because they would react violently with one another if combined, the two components of the bi-propellant fuel systems are generally stored separately until they are contacted with one another in the engine to provide thrust. The oxidizer composition is generally held separately in one tank while the fuel composition containing the fuel compound or compounds and any other additives is held in another tank.

The fuel composition contains an azide compound that has at least one tertiary nitrogen atom and at least one azide functional group on the molecule. An azide functional group is represented by $—N_3$. Upon oxidation after contact with the oxidizer composition, the azide compound loses nitrogen and reacts to produce the energy needed to provide thrust.

A preferred azide compound is one represented by the structure

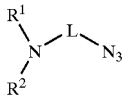

where L is a linking group and where $R^1$ and $R^2$ are independently alkyl or substituted alkyl. Alternatively, $R^1$ and $R^2$ together may form a cyclic group. In general, L can be any divalent linking group that connects the azide functional group with the tertiary nitrogen. The linking group L provides a carbon bonded to the tertiary nitrogen and a carbon bonded to the azide functional group. A preferred linking group L is an alkylene group. Preferably, the alkylene group has from two to eight carbons. When $R^1$ and $R^2$ are alkyl or substituted alkyl, it is preferred that the alkyl groups contain one to four carbons. In a preferred embodiment, $R^1$ and $R^2$ are both methyl.

The groups $R^1$ and $R^2$ may also together form a cyclic group. The cyclic group will contain the nitrogen to which $R^1$ and $R^2$ are attached and may further comprise other atoms such as carbon, nitrogen, sulfur, and oxygen. For example, the ring formed by groups $R^1$ and $R^2$ may be a pyrollidine or morpholine ring. An azide compound of the invention having a pyrollidine ring is given by the structure

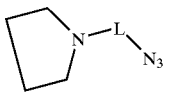

while a morpholine-ring compound is illustrated by the following general structure

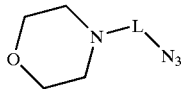

Suitable azide compounds having both a tertiary nitrogen and an azide functional group may be conveniently synthesized by reacting an azide such as sodium azide with a halogenated compound containing the tertiary amine functionality. For the case of DMAZ, where L is an ethylene group and $R^1$ and $R^2$ are both methyl groups, the reaction scheme is given by

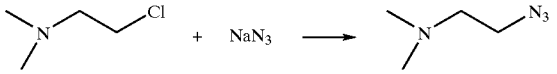

The hydrochloride or other quaternary salt of the tertiary amine starting material may also be used. The starting materials can be reacted together in a solvent such as water for a few hours until reaction is complete. Other azide compounds of the invention may be prepared by using the appropriate corresponding tertiary amine starting material. Some experimental samples of such compounds are available commercially, for example DMAZ from 3M.

The fuel composition also contains a catalyst. The catalyst is a transition metal compound, preferably an organometallic compound of a transition metal. Preferred transition metals include cobalt and manganese. In a preferred embodiment, the catalyst is a cobalt organometallic compound. Examples of organometallic compounds include, without limitation, carboxylic acid salts and naphthenates. It is preferred to use commercially available carboxylic acid salts of transition metals. Such include, without limitation, cobalt 2-ethylhexanoate (available commercially as Cobalt Hex-Cem from OMG) and manganese neodecanoate. Preferred transition metal carboxylates are provided commercially as solutions in organic solvents. An example is Hex-Cem, available as a 12% cobalt active solution in mineral spirits.

The catalyst is added to the azide compound to produce a transition metal level in the fuel composition of about 0.2% or greater. The catalyst level may take on a wide range of values above that minimum. To a certain extent, the level of catalysts may be increased so as to make the fuel composition useful with oxidizer compositions containing a relatively lesser amount of the peroxide, as discussed above. In general, it is desirable to use as small an amount of catalyst that is effective to produce the hypergolic reaction as is possible, so as to avoid metal contaminants in the burned fuel in the engine. Preferred levels of metal in the fuel composition are from 0.2% to about 4% by weight and preferably from about 0.2% to about 1% by weight.

It has been found that addition of the transition metal catalyst to the fuel composition makes the fuel propulsion system hypergolic when the fuel composition is contacted with the oxidizer composition. Advantageously, the fuel composition may contain further amounts of hydrocarbon fuels. Such hydrocarbon fuels include gasoline, kerosene, diesel fuel and conventional rocket and aviation fuels. Such fuels are generally distillation cuts of petroleum oil and their use in propulsion systems is well known. The hydrocarbon fuel may be added to the fuel compositions of the invention up to a level of 90% by weight, based on the total weight of the azide compound and the hydrocarbon fuel. When the fuel composition of the invention contains up to 90% by weight of a hydrocarbon fuel, the azide compound can be thought of as functioning as a promoter in a ternary fuel mixture containing hydrocarbon fuel, azide compound and catalyst. Examples of hydrocarbon fuels that can be added to the fuel compositions of the invention include conventional aviation fuels such as those designated by JP-4 (also known as Jet B) and JP-8 (also known as Jet A). A synthetic aviation fuel such as JP-10, may also be used. In addition, rocket fuels such as RP-1 may be used.

The oxidizer composition of the invention contains hydrogen peroxide. Hydrogen peroxide is available commercially as aqueous solutions of various strengths. It has been found that hydrogen peroxide compositions containing about 85% or greater hydrogen peroxide are useful as the oxidizer composition of the invention. Accordingly, a preferred oxidizer is hydrogen peroxide of an 85% or greater concentration in water.

Higher concentrations of peroxide may be used. It is generally observed that when a higher concentration of peroxide is used, a correspondingly lesser amount of transition metal catalyst may be used in the fuel composition. The ignition delay after contact of the fuel composition and the oxidizer composition may be varied by choosing appropriate levels of hydrogen peroxide concentration and transition metal catalyst concentration.

Inside a rocket engine, the fuel component and the oxidizer component are held in separate pressurized tanks. When valves are opened, the components in the tanks are brought together into contact and ignition occurs spontaneously. In a preferred embodiment, there is a delay after contact before ignition that ranges from about 0.5 milliseconds to 100 milliseconds. Preferably, the delay before ignition is about 16 milliseconds or less. As noted above, the delay time may be adjusted somewhat by varying the levels of peroxide and catalyst in the compositions.

The fuel composition and the oxidizer composition are brought into contact in stoichiometric ratios that lead to the desired ignition. Such a stoichiometric ratio is commonly referred to as the oxidizer to fuel ratio. In general with hypergolic fuels in rocket or missile engines, the oxidizer to fuel ratio may vary over a relatively wide range, depending on the performance desired, propellant tank pressures and other operating parameters. For example, the oxidizer to fuel ratio may range from 1 to 7. Preferably, the oxidizer to fuel ratio is selected to achieve maximum performance of the propellant combination. In one embodiment, the DMAZ and cobalt ethylhexanoate fuel combination with hydrogen peroxide is used at a oxidizer to fuel ratio of about 4.

The oxidizer to fuel ratio in an engine may be conveniently varied by changing the relative pressure in the tanks containing the fuel or the oxidizer. For example, an increase in pressure on the oxidizer tank leads to greater fluid flow of the oxidizer through the valve. The greater fluid flow is translated into a higher stoichiometric portion of oxidizer and a higher oxidizer to fuel ratio. For each combination of fuel and oxidizer, an optimum oxidizer to fuel ratio may be selected by experimentation. Generally, the density impulse of the fuel burned in the engine is a function of oxidizer to fuel ratio.

With most hypergolic fuel propulsion systems, it is common practice to contact the fuel component and the oxidizer component by using what is known is an oxidizer lead. In other words, the oxidizer stream driven by the pressurized oxidizer tank is introduced into the combustion chamber prior to the fuel stream. In the hypergolic fuels of the present invention, it has been found preferable to introduce the fuel composition into the combustion chamber before the oxidizer composition. In other words, for the fuels of the invention, it is preferred to use a fuel lead.

Drop tests are performed with the hypergolic fuel propulsion systems of the invention by providing a dish containing a fuel composition according to the invention and dropping an oxidizer composition onto the surface of the fuel. In a successful test, a fire or flash is observed instantaneously upon contact of the two compositions. Alternatively, the drop test can be performed by dropping a fuel composition onto an oxidizer composition in a dish. In such tests, the oxidizer to fuel ratio is not critical. The test is a qualitative indication of whether the particular combination of fuel and oxidizer is in fact hypergolic.

In injector tests, a fuel composition and an oxidizer composition are brought into contact by using pressurized injectors. The injectors may be single element injectors where there is one hole for the fuel composition and one for the oxidizer composition. It is also possible to use a triple element injector containing two fuel injectors and one oxidizer injector. Other arrangements of injectors are possible. Special injectors can be provided where the number of oxidizer holes, the number of fuel holes and the size of each of the holes varies. In such tests, the oxidizer to fuel ratio is related to the number of injectors of the fuel composition as against the oxidizer composition, to the pressure in the tanks containing the fuel composition and the oxidizer composition, and to the size of the injector holes. The timing of adding the fuel composition stream and the oxidizer composition stream can be adjusted as described above to provide for either a fuel lead or an oxidizer lead. In injector tests with the hypergolic fuels of the invention, it is preferred to use a fuel lead.

The ignition delays observed in the following examples result not only from the chemical composition, but also from limitations imposed by test methods. For example, ignition delays from drop tests are also a function of impingement method (pipettes), drop height, velocity and quantity. Camera speed was limited to 16 msec. The open face injector testing ignition delay measurements are additionally affected by flow meter accuracy. It should also be borne in mind that the ignition timing is affected because the engine does not have a thrust chamber. In some instances, the black and white high speed camera pictures were subject to some uncertainty in interpretation due to poor quality when taken with a frame speed of 2 msec.

EXAMPLES

Example 1

Open face single element injector tests were performed using a fuel composition containing 85% by volume DMAZ and 15% by volume Cobalt Hex-Cem containing 12% cobalt ethylhexanoate in mineral spirits. The mixture contained 1.2% by weight cobalt metal. The oxidizer stream consisted of 90% by weight hydrogen peroxide in water. A fuel lead of 100 msec was used. The oxidizer to fuel ratio varied during the testing from 2 to 4. The fuel ignited late, away from the injector face at about 100 msec ignition delay. The drop test corresponding to this mixture using 90% by weight hydrogen peroxide resulted in an ignition delay of less than 16 msec.

Example 2

A drop test was carried out with a fuel composition containing 97.3% by volume DMAZ and 2.7% by volume Cobalt Hex-Cem catalyst. The mixture contained 0.2% by weight cobalt metal. The drop test ignition delay of this fuel combination with 85% by weight hydrogen peroxide was less than 48 msec.

Example 3

A drop test was carried out with a fuel composition containing 60% by volume JP-10, 27% by volume DMAZ and 13% by volume Cobalt Hex-Cem catalyst. The mixture contained 1.0% by weight cobalt metal. The drop test ignition delay of this fuel combination with 88% by weight hydrogen peroxide was less than 32 msec.

Example 4

Open face single element injector tests were performed using a fuel composition containing 50% by volume DMAZ and 50% by volume Cobalt Hex-Cem containing 12% cobalt ethylhexanoate in mineral spirits. The oxidizer stream consisted of 98% by weight hydrogen peroxide in water. Propellant leads of 100 msec of oxidizer and then 100 msec leads with fuel were tested. The oxidizer to fuel ratio varied during the testing from 1.5–4.5. The fuel ignited upon contact at the open face injector within 6–8 msec ignition delay. The drop test corresponding to this mixture using 90% by weight hydrogen peroxide resulted with an ignition delay of less than 16 msec.

Example 5

A drop test was carried out with a fuel composition containing 60% by volume JP-8, 27% by volume DMAZ, and 13% by volume Cobalt Hex-Cem catalyst. The mixture contained 1.0% by weight cobalt metal. The drop test ignition delay of this fuel combination with 88% by weight hydrogen peroxide was less than 64 msec.

The invention has been described above with respect to preferred embodiments. The description and the examples are non-limiting and variations apparent to those of skill in the art are intended to be within the scope of the invention as defined in the appended claims.

What is claimed is:

1. A hypergolic fuel propulsion system comprising:

a) a fuel composition comprising an azide compound having at least one tertiary nitrogen and at least one azide functional group;

b) a catalyst comprising a transition metal compound; and c) an oxidizer composition comprising hydrogen peroxide; wherein the transition metal compound is selected from the group consisting of cobalt carboxylates, cobalt naphthenates, manganese carboxylates, and manganese naphthenates.

2. A propulsion system according to claim 1 wherein the azide compound is represented by the structure

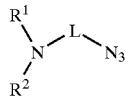

wherein L is a linking group and wherein $R^1$ and $R^2$ are independently alkyl or substituted alkyl or together form a cyclic group.

3. A propulsion system according to claim 2 wherein L is an alkylene group.

4. A propulsion system according to claim 2 wherein $R^1$ and $R^2$ are independently $C_{1-4}$ alkyl.

5. A propulsion system according to claim 2 wherein L is $C_{2-8}$ alkylene and $R^1$ and $R^2$ are methyl.

6. A propulsion system according to claim 1 wherein the oxidizer comprises aqueous hydrogen peroxide comprising at least 85% by weight $H_2O_2$.

7. A propulsion system according to claim 1 wherein the catalyst comprises a cobalt organometallic compound.

8. A propulsion system according to claim 7 wherein the catalyst comprises a carboxylic acid salt.

9. A propulsion system according to claim 1, wherein the fuel composition further comprises a hydrocarbon fuel at up to 90% by weight based on the total weight of the azide compound and the hydrocarbon fuel.

10. A hypergolic fuel composition comprising:

a) a fuel composition comprising 2-(dimethylamino) ethylazide; and b) a catalyst comprising a transition metal organometallic compound;

c) an oxidizer composition comprising hydrogen peroxide; and wherein the organometallic compound is selected from the group consisting of carboxylic acid salts and naphthenates.

11. A composition according to claim 10, wherein the catalyst comprises a cobalt compound.

12. A composition according to claim 10, wherein the oxidizer contains up to 15% by weight water based on the total weight of hydrogen peroxide and water.

13. A composition according to claim 10, wherein the fuel composition further comprises a hydrocarbon fuel at up to 90% by weight based on the total weight of the 2-(dimethylamino)ethylazide and hydrocarbon fuel.

14. A method for propelling a vehicle by burning fuel in an engine, comprising the steps of:

providing a fuel composition comprising:

an azide compound having a tertiary nitrogen and azide functionality; and a catalyst comprising a transition metal organometallic compound wherein said transition metal is selected from the group consisting of cobalt carboxylates, cobalt naphthenates, maganese carboxylates, and manganese naphthenates;

providing an oxidizer composition comprising hydrogen peroxide; and contacting the fuel composition with the oxidizer composition in the engine to provide a fuel mixture that spontaneously ignites.

15. A method according to claim 14, wherein the fuel composition further comprises a hydrocarbon fuel at up to 90% by weight based on the total weight of the azide compound and the hydrocarbon fuel.

16. A method according to claim 14 wherein the catalyst comprises up to 15% by weight water.

17. A method according to claim 14, wherein the azide compound comprises 2-(dimethylamino)ethylazide and the catalyst comprises an organometallic compound based on a transition metal selected from the group consisting of cobalt and manganese.

* * * * *